US005874697A

United States Patent [19]

Selker et al.

[11] Patent Number: 5,874,697

[45] Date of Patent: Feb. 23, 1999

[54] THIN KEYBOARD SWITCH ASSEMBLY WITH HINGED ACTUATOR MECHANISM

[75] Inventors: Edwin Joseph Selker, Palo Alto; William Marvin Dyer, San Jose, both of Calif.; Jeffrey Daniel Allison, Seattle, Wash.

[73] Assignee: International Business Machines Corporation, Armonk, N.Y.

[21] Appl. No.: 801,833

[22] Filed: Feb. 14, 1997

[51] Int. Cl.[6] ..... H01H 13/70

[52] U.S. Cl. ..... 200/5 A; 200/343; 200/517

[58] Field of Search ..... 200/86 R, 5 R, 200/5 A, 6 A, 17 R, 18, 512–517, 329, 330, 332, 341, 343, 344, 345

[56] References Cited

U.S. PATENT DOCUMENTS

| | | | |
|---|---|---|---|
| 3,532,003 | 10/1970 | Ohno | 200/329 X |
| 3,678,483 | 7/1972 | Bartocci | 395/570 |
| 4,029,916 | 6/1977 | Chu | 200/5 A X |
| 4,032,729 | 6/1977 | Koistinen | 200/5 A X |
| 4,055,734 | 10/1977 | Hayden | 200/5 A X |
| 4,066,860 | 1/1978 | Kawasaki | 200/5 A X |
| 4,158,230 | 6/1979 | Washizuka et al. | 200/5 A X |
| 4,160,886 | 7/1979 | Wright et al. | 200/5 A |
| 4,190,748 | 2/1980 | Langford | 200/5 A |
| 4,271,333 | 6/1981 | Adams et al. | 200/5 A X |
| 4,315,114 | 2/1982 | Monti, Jr. | 200/5 A |
| 4,323,740 | 4/1982 | Balash | 200/5 A |
| 4,351,988 | 9/1982 | Allbright | 200/5 A |
| 4,638,151 | 1/1987 | Suwa | 200/5 A X |
| 4,755,796 | 7/1988 | Cheng | 200/330 |
| 5,003,140 | 3/1991 | Abell, Jr. et al. | 200/344 |
| 5,278,372 | 1/1994 | Takagi et al. | 200/344 |
| 5,280,147 | 1/1994 | Mochizuki et al. | 200/344 |
| 5,329,084 | 7/1994 | Watanabe et al. | 200/344 |
| 5,382,762 | 1/1995 | Mochizuki | 200/5 A |
| 5,457,453 | 10/1995 | Chiu et al. | 341/22 |
| 5,481,074 | 1/1996 | English | 200/5 A |
| 5,516,996 | 5/1996 | Shin | 200/345 |

*Primary Examiner*—J. R. Scott

*Attorney, Agent, or Firm*—Romualdas Strimaitis; James C. Pinter

[57] ABSTRACT

Disclosed are keyswitches and a keyboard assembly comprising a sheet member having a plurality of key faces fixed thereon in a conventional keyboard arrangement, a plurality of cutouts in the sheet member partially surrounding each key face, and a plurality of living hinges in the sheet member at one side of each key face, whereby the key face may be depressed, causing the key face to pivot about the living hinges to operate a corresponding set of electrical contacts, indicating operation of the key. A conventional rubber spring may transmit the pivot motion of the key face to the electrical contacts.

17 Claims, 4 Drawing Sheets

THIN KEYBOARD SWITCH ASSEMBLY WITH HINGED ACTUATOR MECHANISM

TECHNICAL FIELD

This invention relates to keyboards, and more particularly keyboards optimized for use with portable data processors.

BACKGROUND OF THE INVENTION

The miniaturization of data processing equipment for portability and ease of use is becoming increasingly important. The limiting factor for reducing the size of portable data processing equipment is generally the keyboard which requires sufficient space for the keys and for the extensive mechanics to convert keystrokes to electrical connections which indicate operation of the keys. The keys are limited in their horizontal size and spacing by the size of an average operator's fingers and hands.

Thus, it is desirable to reduce the vertical dimension, or "thickness", of the keyboard as much as possible. A typical portable data processor, or "portable personal computer" or "personal digital assistant", has a keyboard panel and a display panel, and the data processor is incorporated within one of the panels. The two panels are then folded together so that the bottom of the keyboard panel and the back of the display panel form an outer case for the folded unit. By reducing the thickness of the keyboard, the thickness of the overall folded unit may also be reduced, making the folded portable data processing unit easier to handle and to carry.

Prior U.S. Pat. No. 5,457,453, Chiu et al., unassigned, illustrates a keyboard having reduced thickness when folded, by moving otherwise conventional plunger keys to depressed positions when folding is to occur.

Prior U.S. Pat. No. 5,280,147, Mochizuki et al., assigned to Brother Kogyo Kabushiki Kaisha, reduces the thickness of the keyboard by the use of scissors-like pivotally connected support levers with pivot connections at one end of each lever to respectively the base and the key, and sliding pivot connections at the opposite ends. A conventional nonlinear rubber spring or "dome" is used to transmit the keystroke to electrical contacts to make the connection, indicating operation of the key.

It is desirable to reduce the height of the keyboard even further as well as to reduce the number of parts and to provide an easily assembled keyboard.

SUMMARY OF THE INVENTION

Disclosed are keyswitches and a thin keyboard assembly comprising a sheet member having a plurality of key faces fixed thereon in a conventional keyboard arrangement, a plurality of cutouts in the sheet member partially surrounding each key face, and a plurality of living hinges in the sheet member at one side of each key face, whereby the key face may be depressed, causing the key face to pivot about the living hinges to operate a corresponding set of electrical contacts, indicating operation of the key. A conventional rubber spring may transmit the pivot motion of the key face to the electrical contacts.

Two embodiments are given, one comprising a planar sheet with a single living hinge at one side of each key, whereby depression of the key face causes the key face to pivot downward about the living hinge. The other embodiment comprises two living hinges at one side of each key, allowing the key face to remain level while the pivoting about both hinges, which key requires a lower force to be operated.

The thin keyswitches and thin keyboard assembly of the present invention advantageously forms a portable data processing unit, and is applicable to other uses, such a a keyboard on the top face of a desk similar to a "desk blotter".

For a fuller understanding of the present invention, reference should be made to the following detailed description taken in conjunction with the accompanying drawings.

DETAILED DESCRIPTION OF THE INVENTION

Incorporation by Reference

Keyboards are essential input devices for many applications, including for personal computers. As described above, such personal computers are often designed to be transportable and have been occupying less cubic volume over time. An example of such a portable personal computer is described in coassigned U.S. Pat. No. 5,198,991, incorporated by reference herein for the purpose of describing the computer per se and the connections between the computer and a folding keyboard, and such description will not be repeated here.

Preferred Embodiments

Figure 1:
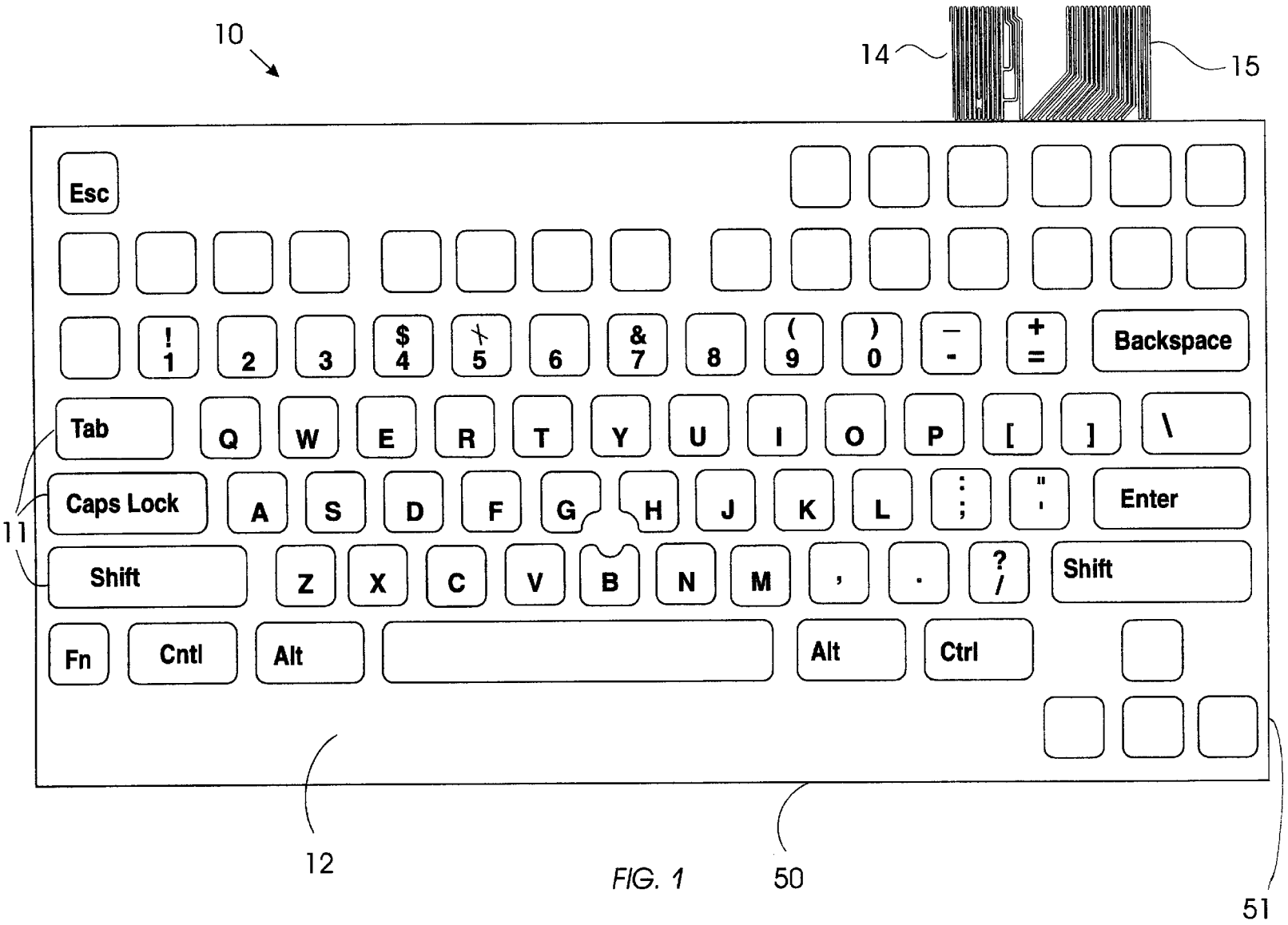
FIG. 1 is a perspective view of a keyboard assembly of the present invention.

Referring to FIG. 1, a keyboard assembly 10 of the present invention is comprised of a plurality of key faces 11 arranged in rows according to the conventional "QWERTY" format. A face plate 12 covers the spaces of the keyboard assembly between the key faces. Electrical lines 14 and 15 extend from the keyboard assembly for connection to a data processor, as will be described.

Figure 2:
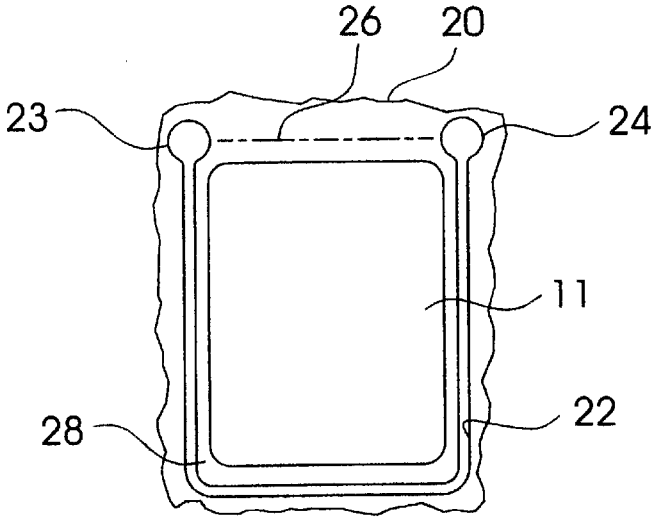
FIG. 2 is a top view of a planar sheet of the present invention for one key of the keyboard assembly of FIG. 1.

FIG. 2 illustrates, in greatly expanded scale, a planar sheet 20 which extends under the face plate 12 of the keyboard assembly of FIG. 1. The planar sheet preferably comprises a plastic material having both aspects of flexibility and of stiffness. The preferred material is Mylar. One of the keyfaces 11 is affixed to and supported by the planar sheet 20. A cutout 22 extends partially around the keyface 11, on three sides thereof. Each end, or terminus, of the cutout 22 may be squared off, or, preferably, comprises a rounded terminus 23 and terminus 24. The termini of the ends of the cutout are connected by a living hinge 26, forming a center section 28 of the planar sheet. Thus, depression of the keyface 11 causes the keyface and center section 28 to pivot downward, rotating about the living hinge 26. The living hinge is a natural consequence of the positioning of the termini 23 and 24, but alternatively may be etched or cut into the planar sheet 20.

Figure 3:
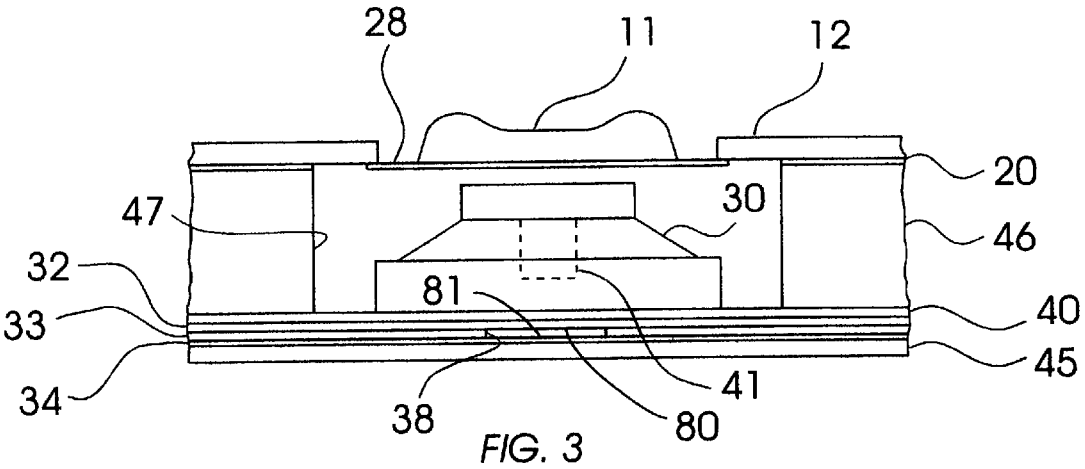
FIG. 3 is a front elevational view of a keyswitch assembly of the present invention for one key of the keyboard assembly of FIG. 1, partly in section.
Figure 4:
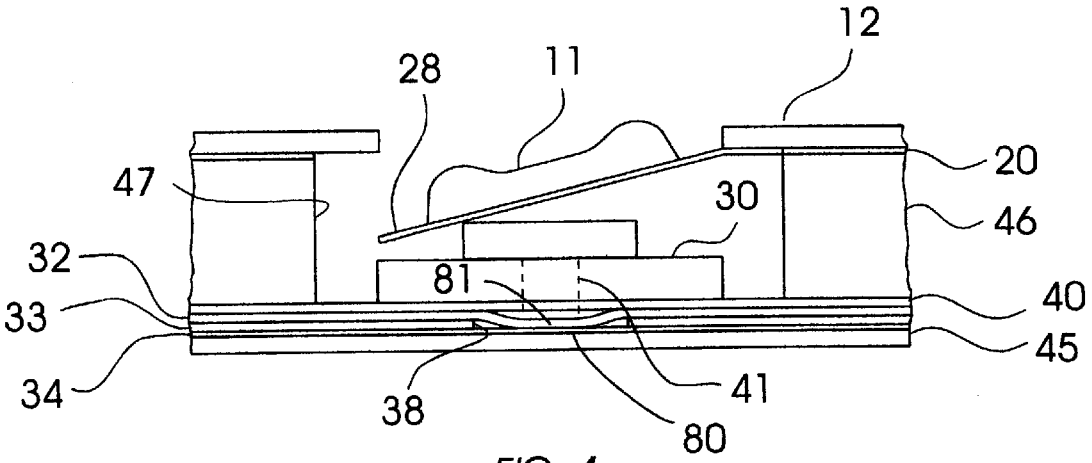
FIG. 4 is a side elevational view of the keyswitch assembly of FIG. 3, partly in section.

FIGS. 3 and 4 comprise respectively front and side views, in greatly expanded scale, of a keyswitch assembly of one of the keyfaces 11 of keyboard assembly 10 of FIG. 1. FIG. 3 illustrates the keyface 11 in the quiescent position, and FIG. 4 illustrates the keyface 11 in the depressed, operated position.

Face plate 12 overlays the planar sheet 20 and center section 28 of the planar sheet supports keyface 11, which is affixed thereto, preferably by cementing. A conventional rubber spring 30, often called a "dome", is located between the center section 28 of the planar sheet and a set of electrical contact members comprising common sheets 32, 33 and 34. Common sheet 32 comprises an uppermost contact member having electrical leads on the bottom side thereof, which connect to lines 15 in FIG. 1. Common sheet 32 is made of an insulating material, preferably also Mylar, and is conventionally used in portable data processors. Common sheet 33 comprises an insulating member having openings 38 therein corresponding to the keyfaces 11. Common sheet 33 is also conventionally used in portable data processors and is preferably made of Mylar. Common sheet 34 is similar to common sheet 32 and comprises a lowermost contact member having electrical leads on the top side thereof, which connect to lines 14 in FIG. 1. An electrical lead 80 of common sheet 32 and an electrical lead 81 of common sheet 34 overlie one another at the location of opening 38 in common sheet 33, and are normally separated as shown in FIG. 3.

Rubber spring 30 is conventionally made of rubber and is positioned under keyface 11 and directly over opening 38. The rubber spring may be individually provided and positioned on top of common sheet 32. In the present invention the rubber springs are preferably positioned on a common sheet 40 and preferably affixed thereto by cementing. The common sheet may be made of Mylar. Alternatively, the common sheet 40 and all of the rubber springs may comprise a single rubber manufacture.

Rubber spring 30 has a center probe 41 extending downward from the top of the spring. The sheet 40 has suitable holes therethrough for the center probe 41 to enter upon depression of keyface 11. The probe 41 transmits vertical force from the keyface 11 and center section 28 of the planar sheet 20 to uppermost common sheet 32 as illustrated in FIG. 4.

The transmitted force by center probe 41 of rubber spring 30 causes uppermost common sheet 32 to be pushed into the hole 38 in insulating common sheet 33 into contact with the lowermost common sheet 34. The electrical lead 80 on the bottom of uppermost common sheet 32 is thereby pressed into contact with the electrical lead 81 on the top of lowermost common sheet 34. This contact creates a connection between one of the lines 15 and one of the lines 14 in FIG. 1, which signals the operation of the depressed keyface 11.

Still referring to FIGS. 3 and 4, a base plate 45 forms the bottom support structure for the keyboard, and a spacer 46 may be provided to support the planar sheet 20. Cavity 47 in the spacer 46 allows placement of the rubber spring 30 and provides an opening for the depression of keyface 11.

The resultant sandwich structure of face plate 12, planar sheet 20, spacer 46, optional sheet 40, electrical contact member common sheets 32, 33, 34, and base plate 45 forms a solid, strong keyboard.

Referring back to FIG. 1, the base plate of the keyboard and face plate 12 are connected together about the periphery of the keyboard as shown by edges 50 and 51. The edges further stiffen the keyboard sandwich, and also protect the outer edges of the sheets between the base plate and face plate. Alternatively, the face plate 12 and the base plate 45 (FIGS. 3 and 4) may be made of very stiff material, as may the edges 50 and 51 surrounding the keyboard 10, allowing spacer 46 to be omitted. In that circumstance, the exterior edges and plates provide the structural strength of the keyboard 10, and may be provided with spacing struts at suitable points to provide additional strength. The planar sheet 20 is then supported by being attached, preferably by cementing, to the underside of face plate 12.

Alternative springs may be used in place of rubber springs 30. The rubber springs or domes have proven advantageous from the standpoints of commercial availability and cost.

Figure 5:
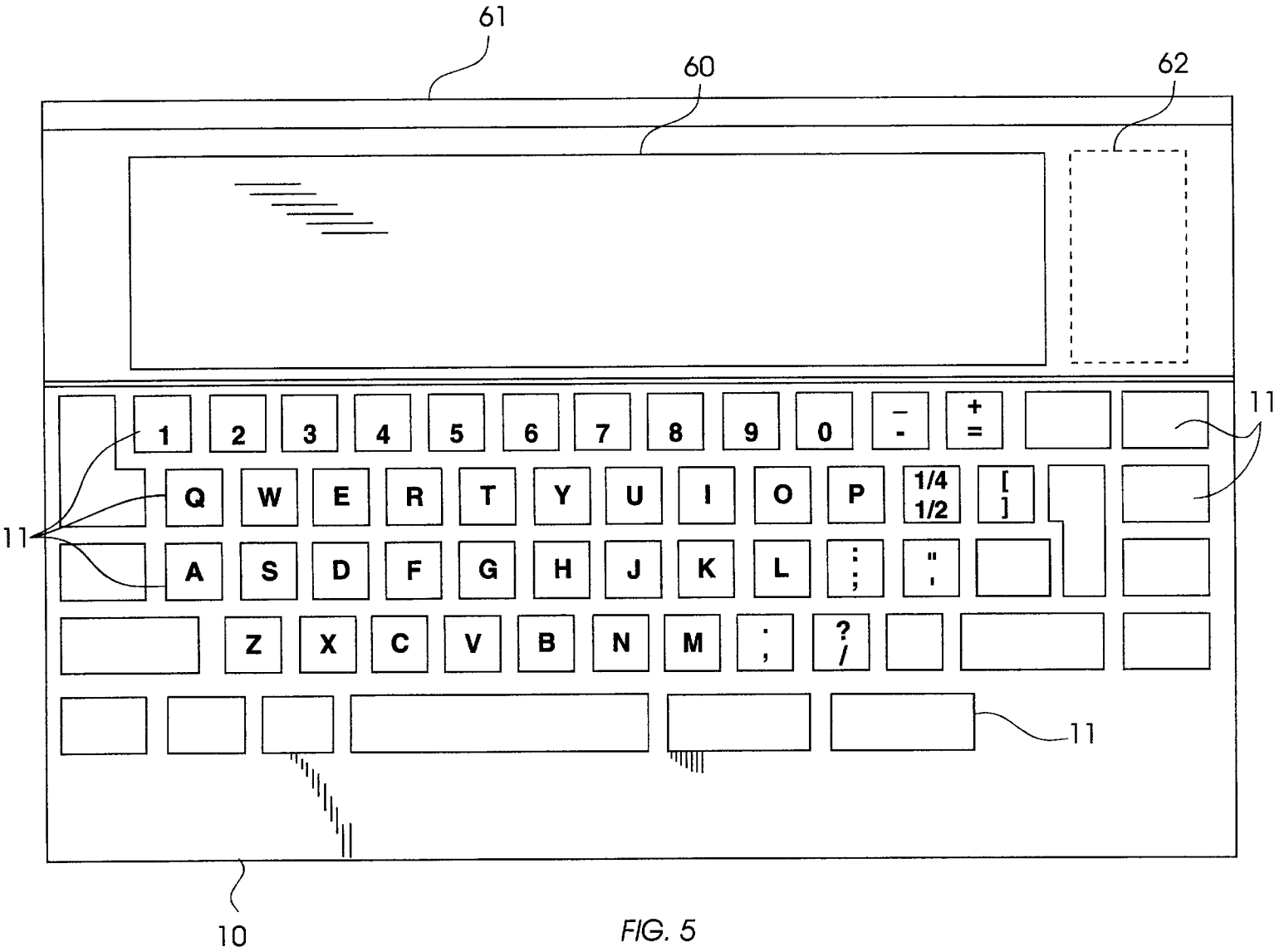
FIG. 5 is a top view of a portable data processor of the present invention in the unfolded, open position.

Referring to FIG. 5, keyboard 10 is shown with an alternative (of many alternatives) layout of keys 11. The keyboard forms the bottom panel of a portable data processor, with a display 60 in a top panel 61. A data processor 62 may be provided either in the top panel 61 (the data processor is shown therein in phantom), or in an opening in the interior of keyboard 10. See the 1991 patent for a detailed description of the interconnection. Referring to FIG. 1, the lines 14 and 15 are arranged for positioning of the data processor in the top panel. The specific arrangement of the electrical connections between the keyboard 10, a data processor and a display is described in the '991 patent, incorporated by reference. In the alternative, the data processor may be in the bottom panel and lines from the electrical contact members would instead be connected to the data processor within the keyboard and other lines provided to connect the data processor to the display 60.

FIG. 5 illustrates the portable data processor unfolded with the display panel in the generally upright position. The display panel 61 folds over keyboard 10 to provide a protected, closed unit with the base plate 45 of the keyboard and the back cover of the display panel forming a protective case.

The very thin vertical dimension of the keyboard 11 allows the folded portable data processor to comprise a small total thickness as well.

Figure 6:
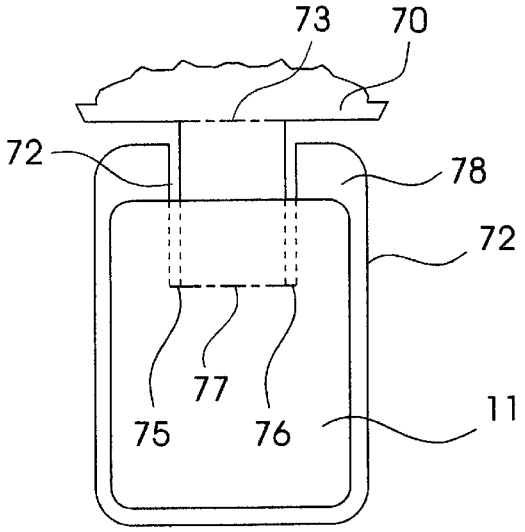
FIG. 6 is a top view of a sheet member with two living hinges of the present invention for one key of the keyboard assembly of FIG. 1.
Figure 7:
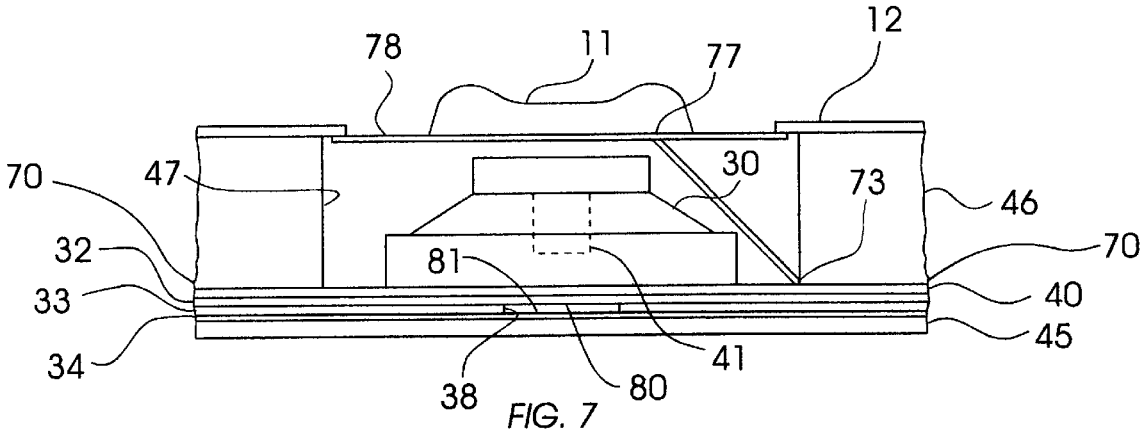
FIGS. 7 and 8 are side elevational views of a keyswitch assembly of the present invention for one key of the keyboard assembly of FIG. 1 using the sheet member of FIG. 6, shown respectively in the unactuated and actuated positions.
Figure 8:
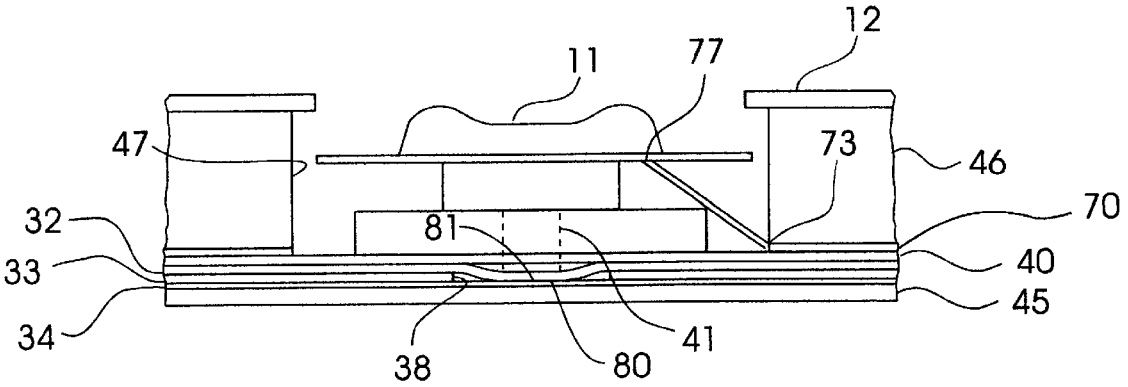

FIGS. 6, 7 and 8 illustrate, in greatly expanded scale, an alternative sheet member and keyswitch arrangement which requires a substantially reduced actuation force. The actuation force for the keyswitch arrangement of FIGS. 2–4 is approximately 80 grams, whereas the arrangement of FIGS. 6–8 is approximately 60 grams. The smaller actuation force is the preferred embodiment of the invention for a "light touch" keyboard.

Referring to FIGS. 6–8, the sheet member 70 extends under the spacer 46 of the keyboard assembly of FIG. 1. The planar sheet 70 is the same material as planar sheet 20, preferably comprising a plastic material having both aspects of flexibility and of stiffness, such as Mylar. One of the keyfaces 11 is affixed to and supported by the planar sheet 70. A cutout 72 extends partially around the keyface 11, on three sides thereof, and forms a first living hinge 73. The cutout 72 continues inward, towards the center of the key 11 to form terminus 75 and terminus 76. The termini of the ends of the cutout are connected by a second living hinge 77, under keyface 11. The cutout 72 thereby forms a center section 28 of the planar sheet and two living hinges 73 and 77. Thus, depression of the keyface 11 causes the keyface and center section 78 to stay level and pivot about living hinges 73 and 77, moving forward slightly, to move from the quiescent, unactuated position of FIG. 7 to the depressed, actuated position of FIG. 8.

The living hinges 73 and 77 are a natural consequence of the positioning of the cutout 72 and the termini 75 and 76, but alternatively may be etched or cut into the planar sheet 70.

The operation of the keyswitch illustrated in FIG. 8 is identical to the operation of the keyswitch illustrated in FIG. 4, described above.

While the preferred embodiments of the present invention have been illustrated in detail, it should be apparent that modifications and adaptations to those embodiments may occur to one skilled in the art without departing from the scope of the present invention as set forth in the following claims.

We claim:

1. A keyswitch assembly comprising:

electrical contact members having normally separated contacts which make electrical contact when vertically compressed; and a living hinge member supporting a key face affixed thereon and pivotable about at least one horizontal axis when said key face is depressed to provide a vertical compressive force to said electrical contact members to make said electrical contact, indicating operation of said key, said living hinge member comprising:

a sheet member having a cutout partially surrounding said key face, on three sides thereof, said cutout continuing, extending inward towards the center of said keyface to a terminus at each end thereof, forming a center section supporting said keyface;

a first living hinge along the axis formed between the points where said partially surrounding cutout continues, extending inward; and a second living hinge extending between said termini.

2. The keyswitch assembly of claim 1, additionally comprising:

a force transmission member disposed between said sheet member center section and said electrical contact members for transmitting said vertical compressive force from said living hinge member to said electrical contact members.

3. The keyswitch assembly of claim 2, wherein:

said force transmission member additionally comprises a spring for supporting said living hinge member in a raised quiescent position when said member is not depressed.

4. The keyswitch assembly of claim 3, additionally comprising:

a face plate positioned on top of said sheet member center section having a hole therein through which said key face extends, for maintaining said sheet member center section in said substantially flat and raised quiescent position against the force of said spring.

5. The keyswitch assembly of claim 4, additionally comprising:

a spacer supporting said face plate on the periphery thereof outside said sheet member center section and said living hinges.

6. The keyswitch assembly of claim 5:

wherein said spacer is between said face plate and the base of said sheet member and has a cavity therein within said periphery, and said force transmission member is disposed between said living hinge member and said electrical contact members within said spacer cavity.

7. A keyboard face member comprising:

a sheet member having at least one key face fixed thereon;

a cutout in said sheet member partially surrounding said key face, on three sides thereof, said cutoff continuing, extending inward towards the center of said cutoff key face at the termini of said cutout;

a first living hinge along the axis formed between the points where said partially surrounding cutout continues, extending inward; and a second living hinge extending between said termini, whereby said key face may be depressed, causing said key face to pivot about said living hinges.

8. The keyboard face member of claim 7, wherein:

said cutout extends along three sides of said key face, and said living hinges extend along axes at a fourth side of said key face.

9. The keyboard face member of claim 7, wherein:

said sheet member has a plurality of key faces in at least one row thereon;

said cutouts extend around said key faces on the same sides of each of said key faces and are separated from each other; and said living hinges extend along axes that are at the same side of each of said key faces, whereby each of said key faces pivot about said respective living hinges along parallel axes.

10. A keyboard assembly comprising:

a sheet member having a plurality of key faces fixed thereon;

a cutout in said sheet member partially surrounding each said key face, extending on both sides thereof, said cutout continuing, extending inward towards the center of said key face at the termini of said cutout;

a first living hinge at each said key face along the axis formed between the points where said partially surrounding cutout continues, extending inward; and a second living hinge at each said key face extending between said termini, whereby said key face may be depressed, causing said key face to pivot about said living hinges to to provide a vertical compressive force; and a plurality of sets of electrical contact members having normally separated contacts which make electrical contact when vertically compressed by said vertical compressive force,indicating operation of said key.

11. The keyboard assembly of claim 10, wherein:

each of said cutouts extends along three sides of a corresponding said key face forming a center section supporting said key face, and said living hinges extend along axes at a fourth side of said corresponding key face.

12. The keyboard assembly of claim 11, wherein:

said plurality of key faces are arranged in at least one row on said sheet member;

said cutouts extend around said key faces on the same sides of each of said corresponding key faces and are separated from each other; and said living hinges extend along axes that are at the same side of each of said corresponding key faces, whereby each of said key faces pivot about said respective living hinges along parallel axes.

13. The keyboard assembly of claim 12, additionally comprising:

a plurality of force transmission members disposed between each said living hinge member and each said set of electrical contact members for transmitting said vertical compressive force from said living hinge member to said corresponding electrical contact members.

14. The keyboard assembly of claim 13, wherein:

each said force transmission member additionally comprises a spring for supporting said corresponding living hinge member in a quiescent position when said member is not depressed.

15. The keyboard assembly of claim 14, additionally comprising:

a face plate positioned on top of said center sections of said sheet member having a plurality of holes therein through which corresponding said key faces extend, for maintaining said center sections in a substantially flat and raised quiescent position against the force of said spring.

16. The keyboard assembly of claim 15, additionally comprising:

a spacer supporting said face plate between said key faces outside said cutouts and said living hinges.

17. The keyboard assembly of claim 16:

wherein said spacer is between said face plate and said sheet member and has a cavity therein aligned with a corresponding one of said key faces within said corresponding cutout and living hinges;

said sheet member is between said spacer and said sets of electrical contact members; and said plurality of force transmission members each disposed between said center section and said electrical contact members and within said spacer cavities.

* * * * *